US010126702B1

(12) United States Patent
Triplett

(10) Patent No.: US 10,126,702 B1
(45) Date of Patent: Nov. 13, 2018

(54) DRIVE COUPLER ACTUATION VIA REPLACEABLE UNIT INSERTION IN AN IMAGE FORMING DEVICE

(71) Applicant: LEXMARK INTERNATIONAL, INC., Lexington, KY (US)

(72) Inventor: Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/846,865

(22) Filed: Dec. 19, 2017

Related U.S. Application Data

(60) Provisional application No. 62/504,730, filed on May 11, 2017.

(51) Int. Cl.

| | |
|---|---|
| ***G03G 15/08*** | (2006.01) |
| ***G03G 21/18*** | (2006.01) |
| ***G03G 21/16*** | (2006.01) |
| ***G03G 15/00*** | (2006.01) |

(52) U.S. Cl.
CPC ..... *G03G 21/1647* (2013.01); *G03G 15/0865* (2013.01); *G03G 15/757* (2013.01)

(58) Field of Classification Search
CPC ..... G03G 15/0865; G03G 21/1647; G03G 21/1821; G03G 21/1842; G03G 21/1857; G03G 21/1864
USPC ..... 399/111, 113, 258
See application file for complete search history.

(56) References Cited

U.S. PATENT DOCUMENTS

| | | | |
|---|---|---|---|
| 7,130,562 | B2 | 10/2006 | Foster et al. |
| 8,867,970 | B2 | 10/2014 | Acosta et al. |
| 9,360,797 | B1 * | 6/2016 | Bayubay et al. .. G03G 15/0865 |

OTHER PUBLICATIONS

U.S. Appl. No. 15/597,714, filed May 17, 2017 (Hale et al.).

* cited by examiner

*Primary Examiner* — William J Royer

(57) ABSTRACT

A system for an electrophotographic image forming device includes a first replaceable unit and a second replaceable unit. A drive coupler in the image forming device is movable between a retracted position and an operative position. In the retracted position, the drive coupler is disengaged from a drive interface of the first replaceable unit when the first replaceable unit is installed in the image forming device. In the operative position, the drive coupler is engaged with the drive interface when the first replaceable unit is installed in the image forming device for providing rotational force to the drive interface. A movable drive linkage in the image forming device is operatively connected to the drive coupler to move the drive coupler from the retracted position to the operative position upon the movable drive linkage receiving an actuation force from the insertion of the second replaceable unit into the image forming device.

18 Claims, 12 Drawing Sheets

DRIVE COUPLER ACTUATION VIA REPLACEABLE UNIT INSERTION IN AN IMAGE FORMING DEVICE

CROSS REFERENCES TO RELATED APPLICATIONS

This application claims priority to U.S. Provisional Patent Application Ser. No. 62/504,730, filed May 11, 2017, entitled "Imaging Unit Drive Actuation via Toner Bottle Insertion in an Electrophotographic Image Forming Device," the content of which is hereby incorporated by reference in its entirety.

BACKGROUND

1. Field of the Disclosure

The present disclosure relates generally to image forming devices and more particularly to drive coupler actuation via replaceable unit insertion in an image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components are positioned in one replaceable unit (an imaging unit). The image forming device's toner supply, which is consumed relatively quickly in comparison with the components housed in the imaging unit, is provided in a reservoir in a separate replaceable unit in the form of a toner cartridge that feeds toner to the imaging unit. In this configuration, the number of components housed in the toner cartridge is reduced in comparison with traditional toner cartridges.

Separate mechanisms are typically used to actuate drive couplers in the image forming device to couple with the imaging unit and to provide the force that holds the toner cartridge in place after the imaging unit and the toner cartridge are installed in the image forming device. In some designs, for example, linkages for actuating the drive couplers are tied to the motion of an access door and a separate mechanism is used to hold the toner cartridge in place. However, the use of linkages tied to the motion of the access door may require a long linkage back to the drive couplers from the access door which may increase the size and complexity of the mechanism. Accordingly, it will be appreciated that a more size and cost efficient mechanism for drive coupler actuation is desired.

SUMMARY

A system for an electrophotographic image forming device according to one example embodiment includes a first replaceable unit insertable into the image forming device with the first replaceable unit having a drive interface exposed on an exterior thereof. A drive coupler mounted in the image forming device is movable between a disengaged position and an engaged position. In the disengaged position, the drive coupler is disengaged from the drive interface of the first replaceable unit when the first replaceable unit is installed in the image forming device. In the engaged position, the drive coupler is engaged with the drive interface of the first replaceable unit when the first replaceable unit is installed in the image forming device for transferring rotational force from the drive coupler to the drive interface of the first replaceable unit. A second replaceable unit is insertable into the image forming device. A movable drive linkage mounted in the image forming device is operatively connected to the drive coupler such that the movable drive linkage moves the drive coupler from the disengaged position to the engaged position upon the movable drive linkage receiving an actuation force from the insertion of the second replaceable unit into the image forming device.

A system for an electrophotographic image forming device according to another example embodiment includes a toner cartridge removable from the image forming device. The toner cartridge has a toner reservoir and an outlet in fluid communication with the toner reservoir for exiting toner from the toner cartridge. An imaging unit removable from the image forming device separately from the toner cartridge has a toner reservoir and an inlet for receiving toner from the outlet of the toner cartridge. The imaging unit has a drive interface for receiving a rotational force. A drive coupler mounted in the image forming device is movable between a retracted position and an operative position. In the retracted position, the drive coupler is disengaged from the drive interface of the imaging unit when the imaging unit is installed in the image forming device. In the operative position, the drive coupler is engaged with the drive interface of the imaging unit when the imaging unit is installed in the image forming device for providing the rotational force from the drive coupler to the drive interface of the imaging unit. A movable drive linkage mounted in the image forming device is operatively connected to the drive coupler such that the movable drive linkage moves the drive coupler from the retracted position to the operative position upon the movable drive linkage receiving an actuation force from the insertion of the toner cartridge into the image forming device.

An assembly for an electrophotographic image forming device according to another example embodiment includes a movable linkage having a first end and a second end. A first pivotable bell crank is operatively connected to the first end of the movable linkage and to a drive coupler such that movement of the linkage in a first direction and a second direction, respectively, moves the drive coupler between a retracted position and an extended position, respectively. In the retracted position, the drive coupler is disengaged from a corresponding drive interface of a first replaceable unit when the first replaceable unit is installed in the image forming device. In the extended position, the drive coupler is engaged with the corresponding drive interface of the first replaceable unit when the first replaceable unit is installed in the image forming device. A second pivotable bell crank is operatively connected to the second end of the movable linkage such that the linkage moves in the second direction upon the second bell crank receiving an actuation force from the insertion of a second replaceable unit into the image forming device moving the drive coupler from the retracted position to the extended position.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
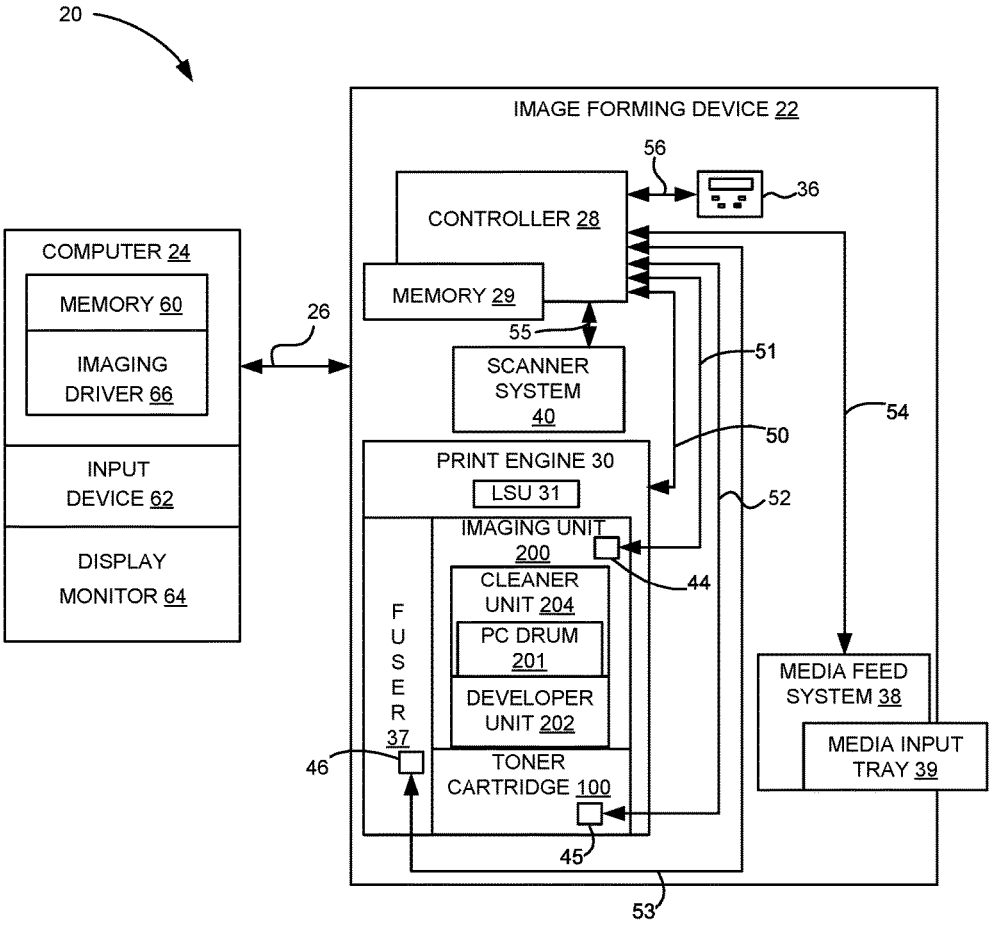
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 202 includes a magnetic roll that attracts the magnetic carrier beads having toner thereon to the magnetic roll through the use of magnetic fields. Imaging unit 200 also includes a cleaner unit 204 that houses photoconductive drum 201 and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 202.

The electrophotographic printing process is well known in the art and, therefore, is described briefly herein. During a printing operation, laser scan unit 31 creates a latent image on photoconductive drum 201 in cleaner unit 204. Toner is transferred from the toner sump in developer unit 202 to the latent image on photoconductive drum 201 by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by photoconductive drum 201 or by an intermediate transfer member that receives the toner from photoconductive drum 201. Toner remnants are removed from photoconductive drum 201 by the waste toner removal system. The toner image is bonded to the media sheet in fuser 37 and then sent to an output location or to one or more finishing options such as a duplexer, a stapler or a hole-punch.

Figure 2:
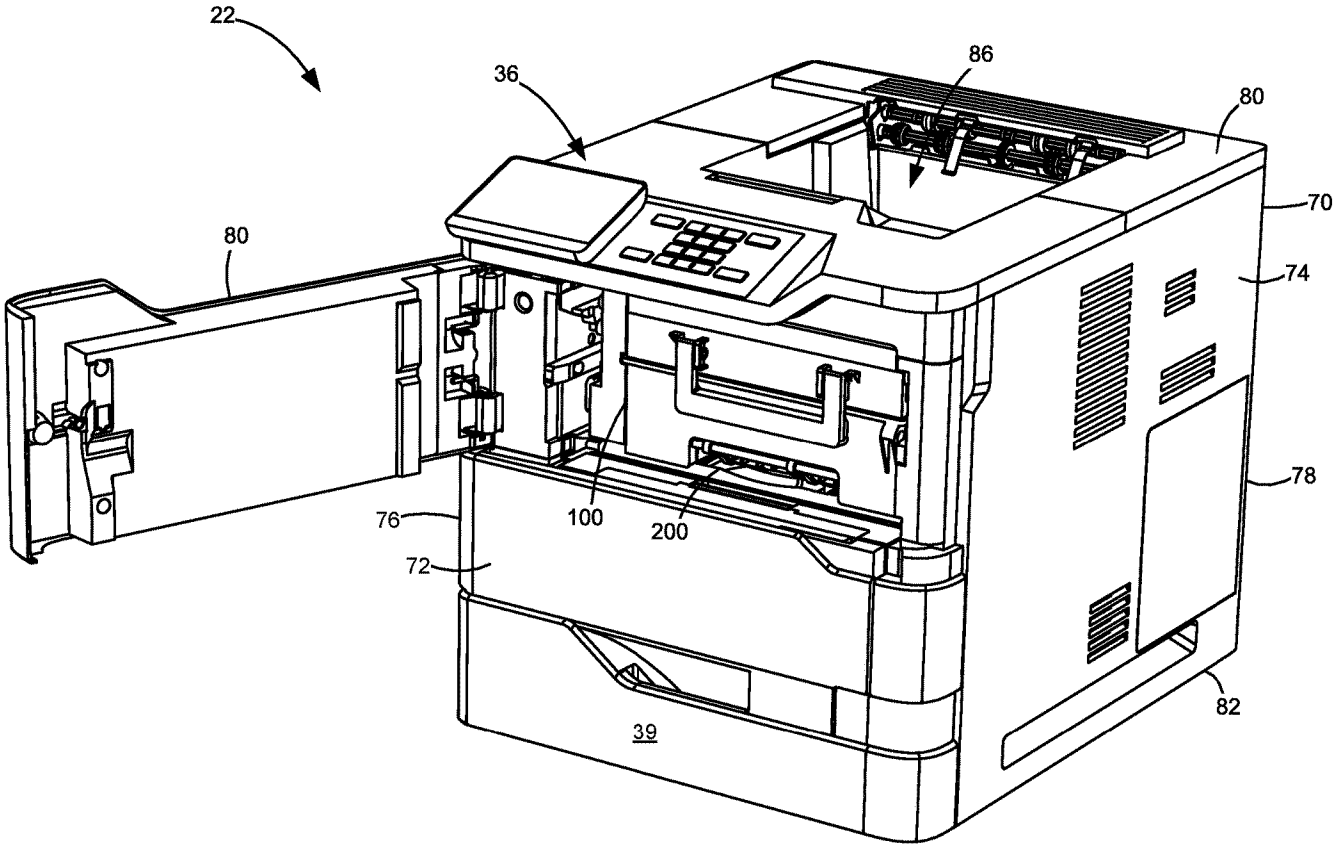
FIG. 2 is a perspective view of an image forming device with an access door of the image forming device opened exposing a replaceable imaging unit and a replaceable toner cartridge according to one example embodiment.
Figure 3:
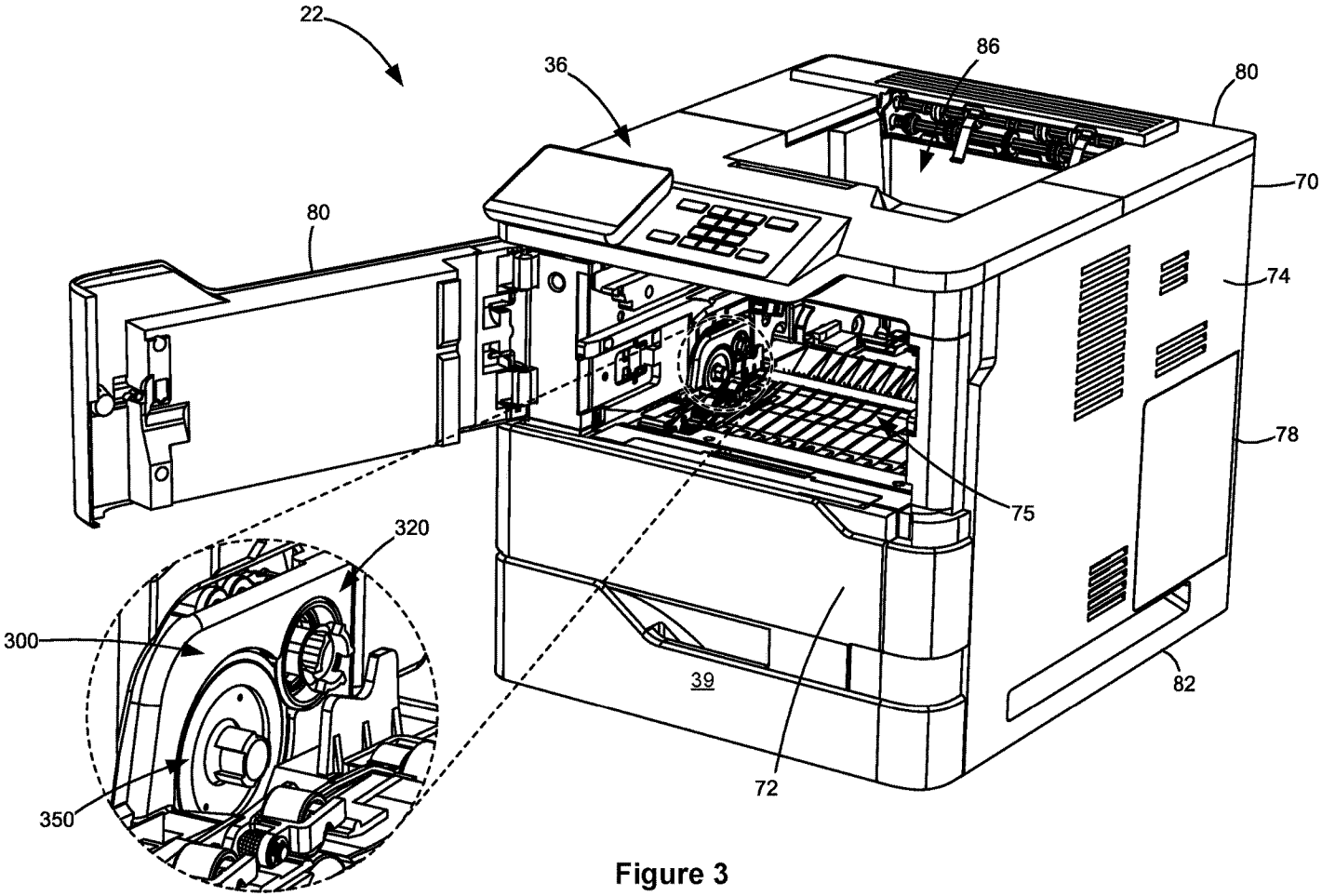
FIG. 3 is a perspective view of the image forming device shown in FIG. 2 with the toner cartridge and the imaging unit removed to expose a drive system for the imaging unit according to one example embodiment.

FIGS. 2 and 3 illustrate an example embodiment of image forming device 22 having a housing 70 that includes a front 72, first and second sides 74, 76, a rear 78, a top 80 and a bottom 82. A media output area 86 is provided on top 80 of housing 70 for collecting printed media exiting image forming device 22. User interface 36 may be located on the front 72 of housing 70 as illustrated. Using the user interface 36, a user is able to enter commands and generally control the operation of the image forming device 22. Removable media input tray 39 for providing media to be printed may be slidably insertable into image forming device 22.

An access door 80 is positioned on housing 70 of image forming device 22 permitting access to interior components of image forming device 22 and allowing the insertion and removal of toner cartridge 100 and imaging unit 200. FIG. 2 shows image forming device 22 with access door 80 in an open position with toner cartridge 100 and imaging unit 200 installed in image forming device 22. FIG. 3 shows image forming device 22 with access door 80 in the open position and toner cartridge 100 and imaging unit 200 removed to expose a drive system 300 mounted internal to image forming device 22 within an opening 75. Drive system 300 is shown having drive couplers 320, 350 positioned to engage and provide rotational force to corresponding drive interfaces 225, 230 (FIG. 4) of imaging unit 200 when imaging unit 200 is installed in image forming device 22. Drive interfaces 225, 230 of imaging unit 200 drive various rotatable components, such as photoconductive drum 201, the developer roll or magnetic roll of developer unit 202 as well as various augers and/or agitators within imaging unit 200. To engage with drive system 300, imaging unit 200 is inserted into opening 75 until its drive interfaces 225, 230 are aligned with corresponding drive couplers 320, 350 of drive system 300 and an actuation force is provided to move drive couplers 320, 350 into engagement with corresponding drive interfaces 225, 230 of imaging unit 200 as discussed in greater detail below.

Figure 4:
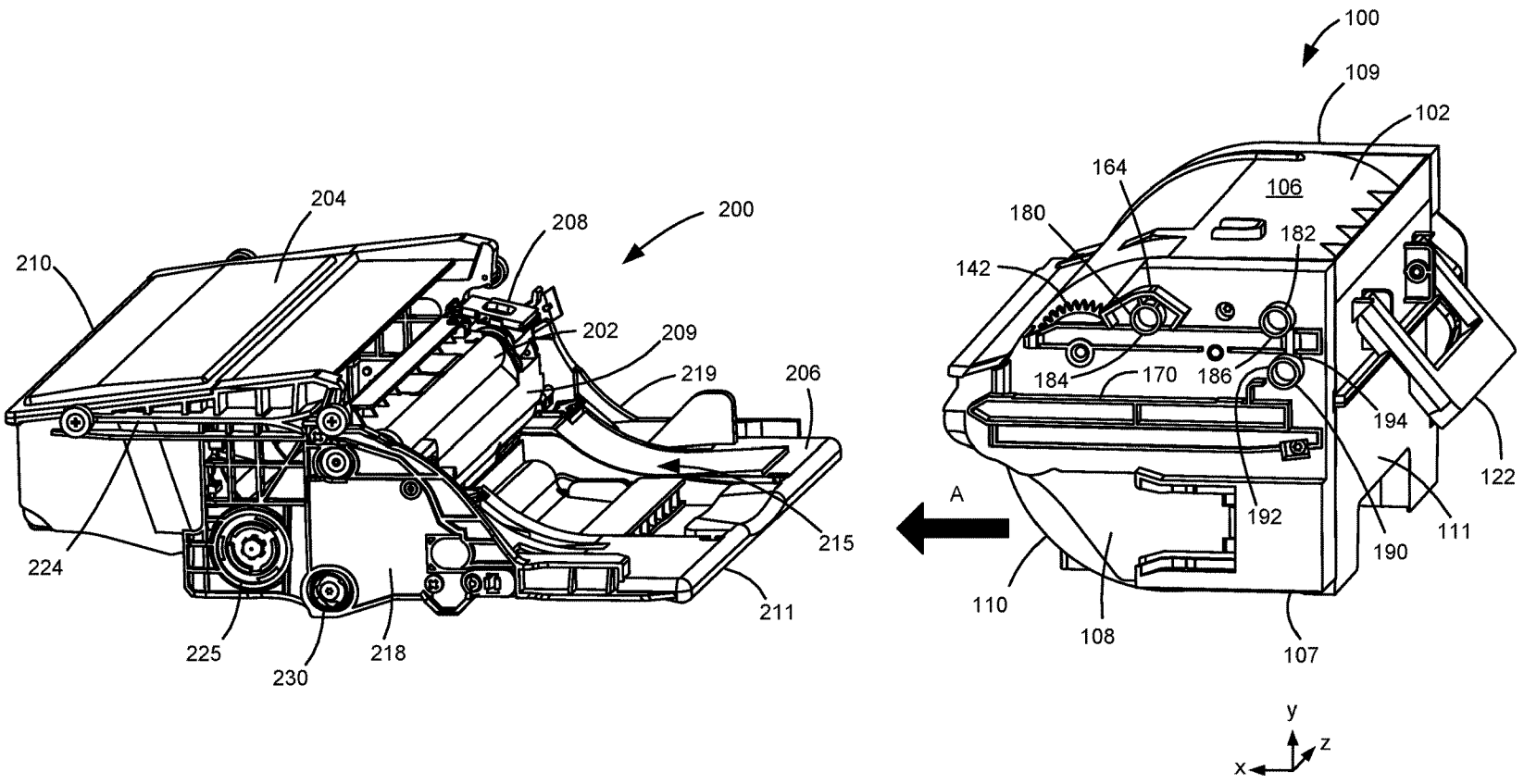
FIG. 4 is a perspective view of the toner cartridge and the imaging unit according to one example embodiment.

Referring now to FIG. 4, toner cartridge 100 and imaging unit 200 are shown according to one example embodiment. Imaging unit 200 includes a developer unit 202 and a cleaner unit 204 mounted on a common frame 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow A shown in FIG. 4, which also indicates the direction of insertion of imaging unit 200 and toner cartridge 100 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

Toner cartridge 100 includes a housing 102 having an enclosed reservoir for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. An outlet port (not shown) in fluid communication with the reservoir is positioned facing downward on front 110 of housing 102 near side 109 for exiting toner from toner cartridge 100. Toner cartridge 100 includes one or more agitators (e.g., paddles, augers, etc.) to stir and move toner within the reservoir toward the outlet port. A drive member 142, which may be a gear or other form of drive coupler, is positioned on first side 108. In the example embodiment illustrated, drive member 142 is shown as an input gear that is positioned to engage a corresponding drive element 90 (FIG. 5) in image forming device 22 when toner cartridge 100 is installed therein in order to receive rotational power to drive the agitator(s) in the reservoir. The agitator(s) within the reservoir may be connected directly or by one or more intermediate gears to drive member 142. A handle 122 may be provided on top 106 or rear 111 of housing 102 to assist with insertion and removal of toner cartridge 100 into and out of image forming device 22.

In the example embodiment illustrated, side 108 includes an alignment guide 170 that extends outward from side 108. Alignment guide 170 travels in a corresponding guide slot 92 (FIG. 5) in image forming device 22 that guides the insertion of toner cartridge 100 into image forming device 22. Alignment guide 170 runs along the front-to-rear dimension of housing 102 as shown in FIG. 4. In the example embodiment illustrated, side 108 also includes an engagement member 164 that extends outward from side 108 near the top 106 of housing 102. Engagement member 164 is positioned to receive a hold down force from a corresponding biasing member in image forming device 22 to retain toner cartridge 100 in its final position in image forming device 22, as discussed in greater detail below. Side 108 also includes a pair of alignment guides 180, 182 that extend outward from side 108. Each alignment guide 180, 182 includes a bottom surface 184, 186 that is unobstructed to permit bottom surfaces 184, 186 of alignment guides 180, 182 to sit on top of a corresponding guide surface 94 (FIG. 5) in image forming device 22 in order to control the vertical position of toner cartridge 100 in image forming device 22. Bottom surfaces 184, 186 of alignment guides 180, 182 are aligned with each other in the vertical dimension of housing 102. In this embodiment, alignment guide 180 is aligned with engagement member 164 along the front-to-rear dimension of housing 102 and alignment guide 182 is spaced rearward from engagement member 164.

In the example embodiment illustrated, side 108 also includes an alignment guide 190 that extends outward from side 108. Alignment guide 190 includes a front surface 192 and a top surface 194 that are unobstructed to permit front surface 192 and top surface 194 to respectively contact corresponding guide surfaces 95, 96 (FIG. 5) in image forming device 22. Front surface 192 of alignment guide 190 serves as a forward stop to control the horizontal position of toner cartridge 100 in image forming device 22 along the front-to-rear-dimension of housing 102. Top surface 194 of alignment guide 190 serves as a rotational stop to prevent rotation of housing 102 within image forming device 22 about an axis parallel to the rotational axis of drive member 142.

Imaging unit 200 includes a housing 209 having an enclosed reservoir for holding toner. Toner inlet port 208 in fluid communication with the toner reservoir of imaging unit 200 aligns with the outlet port of toner cartridge 100 when toner cartridge 100 is installed along frame 206 and mated with developer unit 202. Each side 218, 219 of imaging unit 200 includes an alignment guide 224 that extends outward from the respective side 218, 219 to assist the insertion of imaging unit 200 into image forming device 22. Alignment guides 224 travel in corresponding guide slots in image forming device 22 that guide the insertion of imaging unit 200 into image forming device 22. In one embodiment, alignment guide 224 on side 218 travels in corresponding guide slot 92 (FIG. 5) in image forming device 22. A front 210 of imaging unit 200 includes cleaner unit 204, which leads during insertion of imaging unit 200 into image forming device 22. Rear 211 of imaging unit 200, which trails during insertion of imaging unit 200 into image forming device 22, provides a cartridge storage area 215 that is sized and shaped to receive toner cartridge 100.

In the example embodiment illustrated, a first drive interface 225 and a second drive interface 230 are positioned on side 218 of imaging unit 200. First and second drive interfaces 225, 230 are positioned to respectively engage first and second drive couplers 320, 350 (FIG. 3) in image forming device 22 when imaging unit 200 is installed therein in order to receive rotational power from drive couplers 320, 350 for rotating various components within imaging unit 200. In one embodiment, first drive interface 225 is connected to photoconductive drum 201 such that rotating first drive interface 225 rotates photoconductive drum 201 and second drive interface 230 is connected to developer unit 202 such that rotating second drive interface 230 rotates the developer roll or magnetic roll of developer unit 202 and/or other rotatable components of developer unit 202. Photoconductive drum 201 and the rotatable components of developer unit 202 may be connected directly or indirectly by one or more intermediate gears to first and second drive interfaces 225, 230, respectively.

Figure 5:
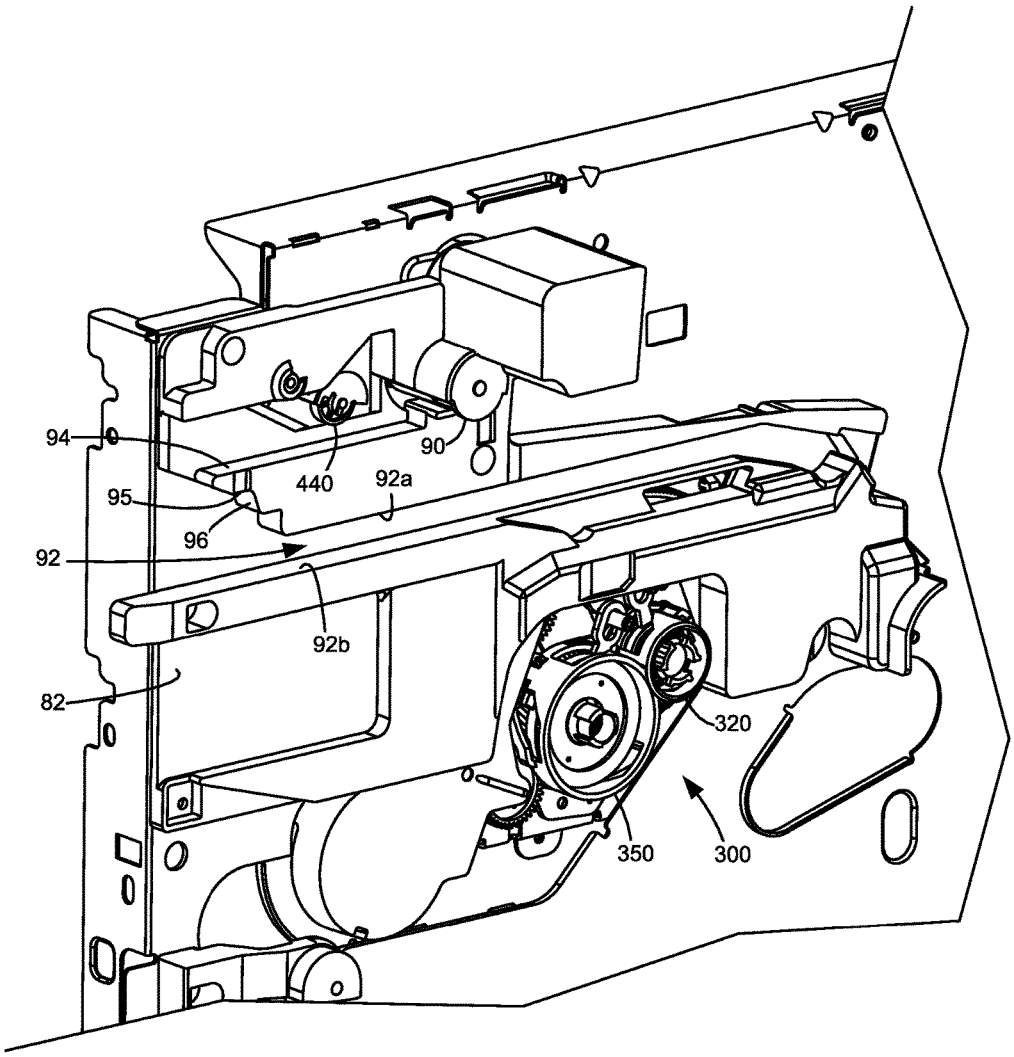
FIG. 5 is a perspective view of an interior side of the image forming device including the drive system shown in FIG. 3.

With reference to FIG. 5, in the example embodiment illustrated, an inner side 82 of image forming device 22 includes drive element 90 for providing rotational motion from an electric motor in image forming device 22 to drive member 142 of toner cartridge 100. The inner side 82 of image forming device 22 also includes drive system 300 including first and second drive couplers 320, 350 that provide rotational motion from one or more electric motors in image forming device 22 to first and second drive interfaces 225, 230 of imaging unit 200, respectively. In this example embodiment, first drive coupler 320 provides rotational power to drive photoconductive drum 201 via first drive interface 225 of imaging unit 200 and second drive coupler 350 provides rotational power to drive the rotatable components of developer unit 202 via second drive interface 230 of imaging unit 200. In one embodiment, a common motor may be used to drive first and second drive couplers 320, 350 of drive system 300 such as by using a gear train connecting first and second drive couplers 320, 350. In other embodiments, separate motors may be used to drive each of first and second drive couplers 320, 350. The inner side 82 of image forming device 22 includes guide slot 92 which is defined by a top guide surface 92*a* and a bottom guide surface 92*b*. Guide slot 92 aids in the insertion of imaging unit 200 and toner cartridge 100 into image forming device 22. For example, as imaging unit 200 is inserted into image forming device 22, alignment guide 224 enters and travels along guide slot 92. As toner cartridge 100 is inserted into image forming device 22, alignment guide 170 also enters and travels along guide slot 92 in image forming device 22. The opposite side of opening 75 that receives imaging unit 200 and toner cartridge 100 may include a similar guide slot to aid in the insertion of imaging unit 200 and toner cartridge 100 into image forming device 22.

Details of drive system 300 will be described with respect to FIGS. 6A-8. In the example embodiment illustrated, each of first and second drive couplers 320, 350 of drive system 300 is movable between a retracted position shown in FIGS. 6A and 6B and an extended position shown in FIGS. 7A and 7B. In the retracted position, each of first and second drive couplers 320, 350 is disengaged from corresponding drive interfaces 225, 230 of imaging unit 200, respectively. In the extended position, each of first and second drive couplers 320, 350 is in an operational position engaged with corresponding drive interfaces 225, 230 of imaging unit 200, respectively, when imaging unit 200 is installed in image forming device 22 for transferring rotational force from drive couplers 320, 350 to drive interfaces 225, 230.

Figure 8:
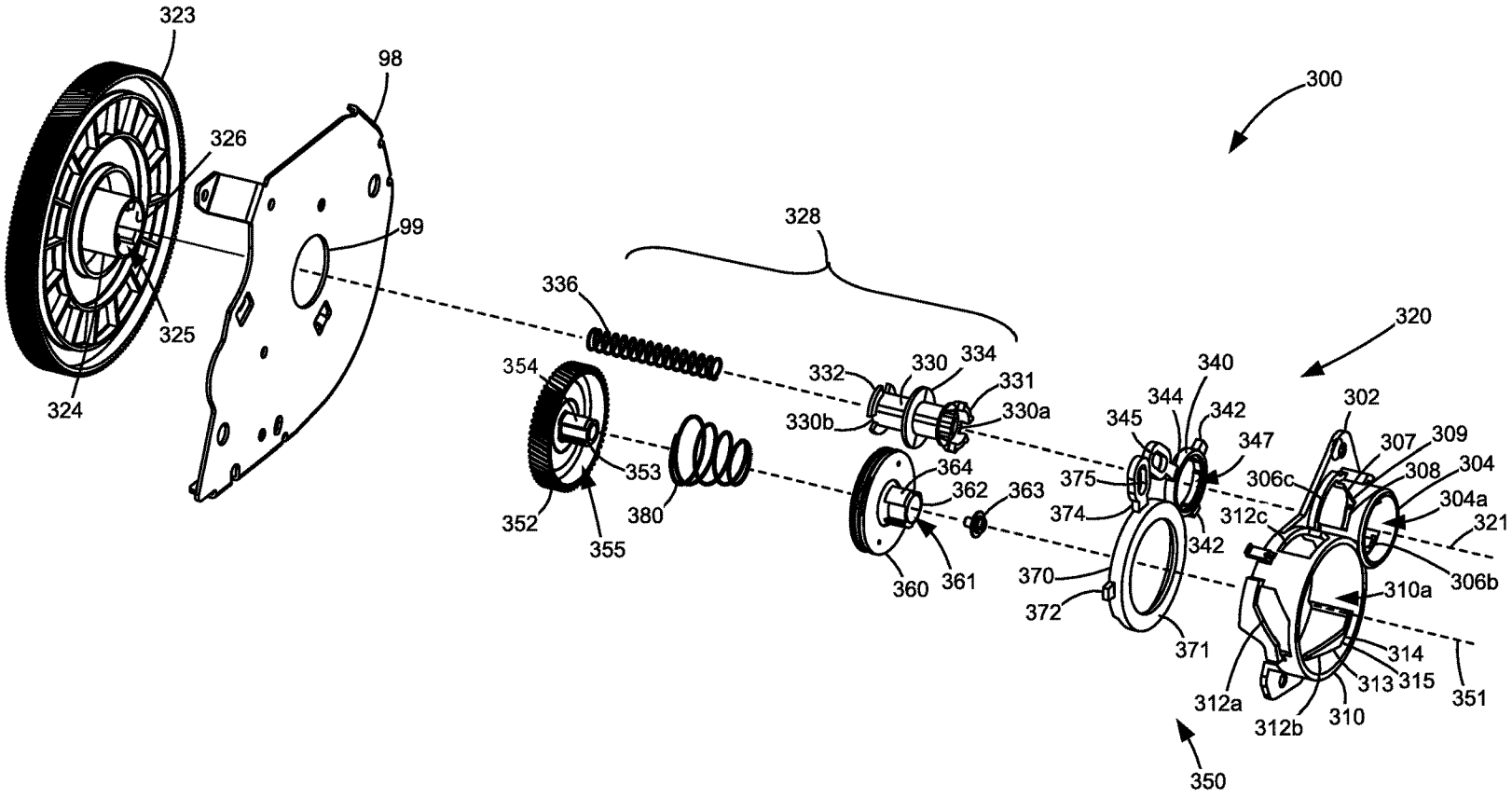
FIG. 8 is an exploded view of the drive system shown in FIGS. 6A-7B.

FIG. 8 illustrates an exploded view of drive system 300 including assemblies of first and second drive couplers 320, 350. Hereinafter, first and second drive couplers 320, 350 may be referred to as first and second drive coupler assemblies 320, 350, respectively. In the example embodiment illustrated, first and second drive coupler assemblies 320, 350 are positioned in a frame housing 302 including a first frame portion 304 and a second frame portion 310. First frame portion 304 houses first drive coupler assembly 320 and second frame portion 310 houses second drive coupler assembly 350. First drive coupler assembly 320 is shown having an axis of rotation 321 and second drive coupler assembly 350 is shown having an axis of rotation 351.

With continued reference to FIGS. 6A-8, first drive coupler assembly 320 includes an input drive gear 323, a spline assembly 328 and a first collar 340. Input drive gear 323 is operatively connected to an electric motor in image forming device 22 that provides rotational motion to input drive gear 323. Input drive gear 323 includes a post 324 that passes through a hole 99 formed on a frame plate 98 on inner side 82 of image forming device 22 for connecting with spline assembly 328. Spline assembly 328 includes a sleeve 330 having a front end 330*a*, a rear end 330*b* and a disk member 334 therebetween. Front end 330*a* of sleeve 330 is configured to mate with first drive interface 225 of imaging unit 200. In the example embodiment illustrated, sleeve 330 includes one or more drive elements on front end 330*a* such as, for example, drive lugs 331 extending outward therefrom and positioned to mate with first drive interface 225 of imaging unit 200. Rear end 330*b* of sleeve 330 is operatively connected to input drive gear 323 such that torque is transferred to sleeve 330 when input drive gear 323 is rotated. In the example embodiment illustrated, rear end 330*b* of sleeve 330 is sized to be slidably received into a center opening 325 of post 324 of input drive gear 323. One or more retention lugs 332 on rear end 330*b* of sleeve 330 extend radially outward therefrom and are positioned to align with and be inserted into corresponding axial channels 326 within center opening 325 of input drive gear 323 to allow sleeve 330 to be rotated when input drive gear 323 is rotated. Spline assembly 328 also includes a biasing member 336 positioned between input drive gear 323 and sleeve 330. In the example embodiment illustrated, biasing member 336 is compressed within center opening 325 of post 324 of input drive gear 323 and a central hollow portion (not shown) of rear end 330*b* of sleeve 330 in order to continuously bias sleeve 330 axially outward, away from frame plate 98 and toward first drive interface 225 of imaging unit 200.

First frame portion 304 of frame housing 302 includes a first opening 304*a* and wall apertures 306*a*, 306*b*, 306*c* (generally designated as wall apertures 306) each having an angled ramp portion 307 and a dwell portion 308, which together form a cam surface 309. Each wall aperture 306 receives a corresponding projection extending radially outward from first collar 340 in order to prevent first collar 340 from exiting first frame portion 304. In the example embodiment illustrated, radial projections extending from first collar 340 include sliding lugs 342 and a first collar arm 344. First collar arm 344 includes an elongated slot 345 at a free end thereof and is used to connect first drive coupler 320 to a drive linkage for moving first drive coupler 320 between the extended and retracted positions in response to insertion and removal of toner cartridge 100 from image forming device 22, as discussed in greater detail below. Sliding lugs 342 extend through wall apertures 306*a*, 306*b*, respectively, while first collar arm 344 extends through wall aperture 306*c*. Sliding lugs 342 and first collar arm 344 are slidable against corresponding angled ramped portions 307 and dwell portions 308 on wall apertures 306*a*, 306*b*, 306*c*, respectively. A center opening 347 of first collar 340 is sized to allow front end 330*a* of sleeve 330 to pass through center opening 347 but obstruct disk member 334 of sleeve 330.

Figure 6A:
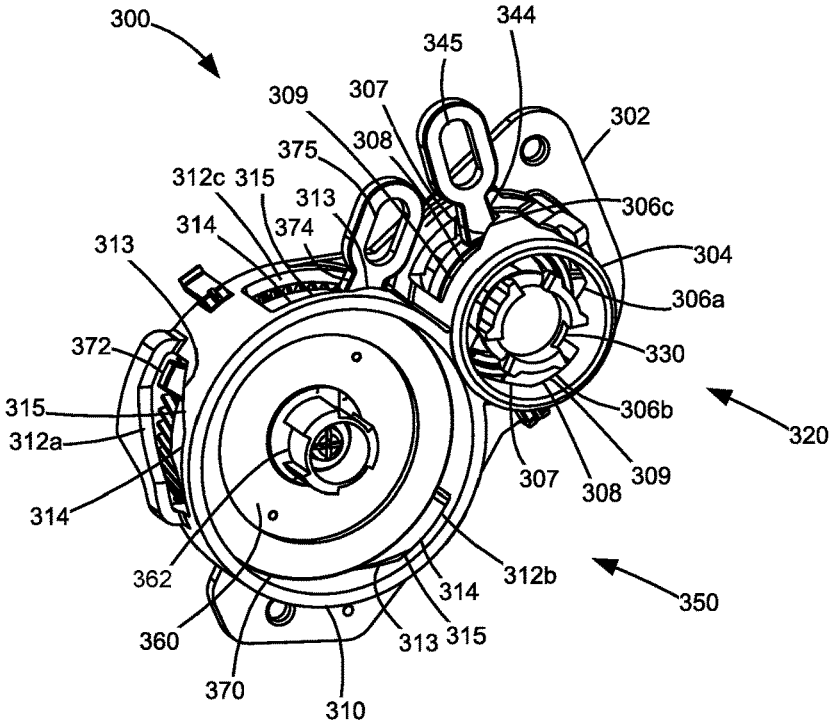
FIGS. 6A and 6B are perspective views of the drive system with drive couplers in a retracted position according to one example embodiment.
Figure 6B:
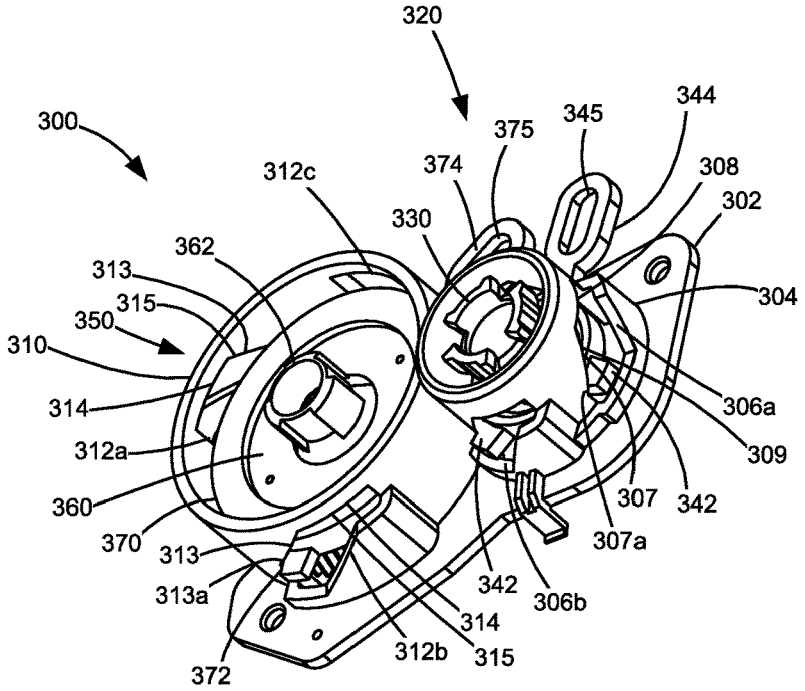
Figure 7A:
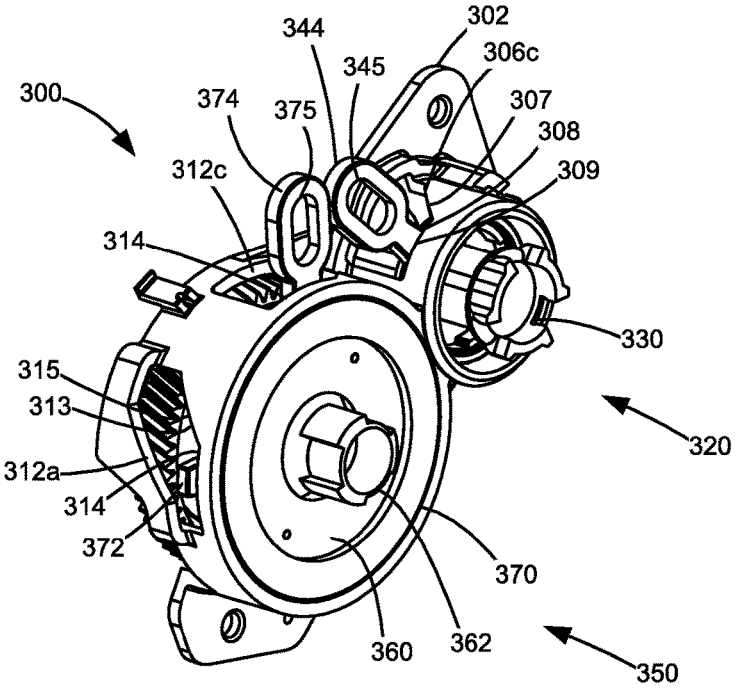
FIGS. 7A and 7B are perspective views of the drive system with the drive couplers in an extended position according to one example embodiment.
Figure 7B:
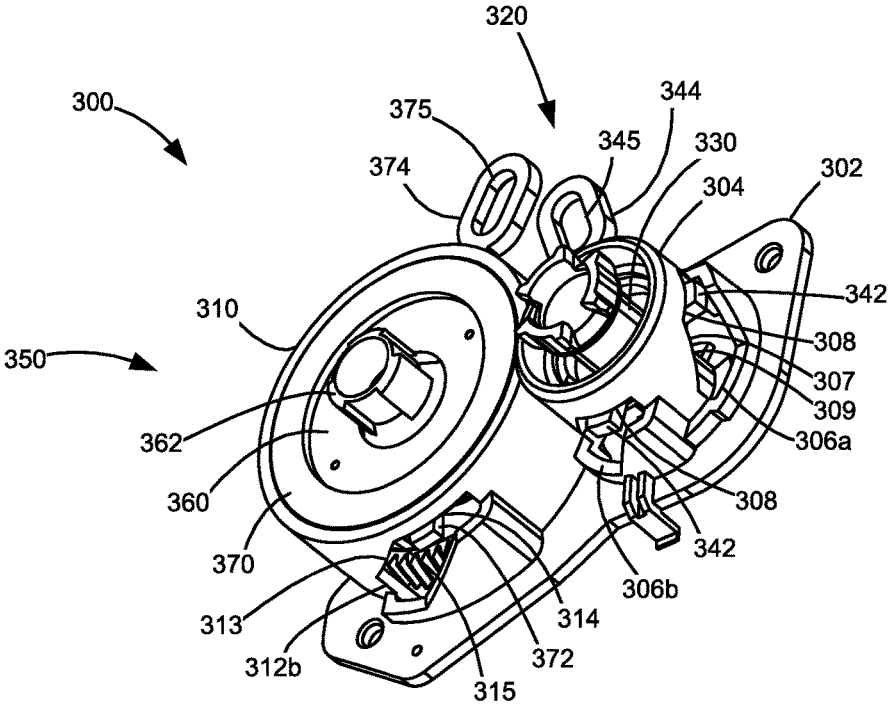

Due to the biasing force provided by biasing member 336 on sleeve 330, disk member 334 of sleeve 330 is biased against first collar 340 causing sleeve 330 to continuously bias first collar 340 axially outward toward first opening 304*a*, which, in turn, causes sliding lugs 342 and first collar arm 344 to be continuously biased against corresponding cam surfaces 309 formed by angled ramp portions 307 and dwell portions 308. Angled ramped portion 307 and dwell portion 308 of each wall aperture 306 defines a range of axial travel of sleeve 330. For example, movement of first collar 340 toward first opening 304*a*, such as the result of the biasing force of biasing member 336, causes sliding lugs 342 and first collar arm 344 of first collar 340 to slide against corresponding angled ramped portions 307 of wall apertures 306 until each of sliding lugs 342 and first collar arm 344 reaches and rests against corresponding dwell portions 308 with drive lugs 331 of sleeve 330 extending beyond first opening 304*a* in the extended position (FIGS. 7A and 7B). Conversely, movement of first collar 340 inwardly toward frame plate 98, such as when the biasing force of biasing member 336 is overcome, causes sliding lugs 342 and first collar arm 344 to slide from corresponding dwell portions 308 to corresponding angled ramped portions 307 until sliding lugs 342 and first collar 344 arm reach ends 307*a* of corresponding angled ramped portions 307 and drive lugs 331 of sleeve 330 are retracted within first opening 304*a* in the retracted position (FIGS. 6A and 6B).

Second drive coupler assembly 350 includes an input gear 352, an output plate 360 and a second collar 370. Output plate 360 includes a drive collar 362 that is configured to mate with second drive interface 230 of imaging unit 200. In the example embodiment illustrated, drive collar 362 includes one or more drive elements such as, for example, drive ribs 364 extending radially outward therefrom and positioned to mate with second drive interface 230 of imaging unit 200. Input gear 352 is rotatably mounted on frame plate 98, such as by using a fastener or a press pin, and is operatively connected to an electric motor in image forming device 22 that provides rotational motion to input gear 352. Input gear 352 has a cavity 355 formed therein and a post 353. Cavity 355 is sized to receive output plate 360 therein. Post 353 of input gear 352 is connected to output plate 360 such that torque is transferred to output plate 360 when input gear 352 is rotated. In the example embodiment illustrated, post 353 is sized to be slidably received into a center opening 361 of output plate 360. One or more axial ribs 354 extend radially outward from post 353 to align with corresponding axial channels (not shown) within center opening 361 of output plate 360 to allow output plate 360 to be rotated when input gear 352 is rotated. A fastener 363 is used to secure output plate 360 within cavity 355 of input gear 352. A biasing member such as, for example, a compression spring 380, is provided between input gear 352 and output plate 360 to continuously bias output plate 360 axially outward, away from frame plate 98 and toward second drive interface 230 of imaging unit 200.

Second frame portion 310 of frame housing 302 includes a second opening 310*a* and wall apertures 312*a*, 312*b*, 312*c*

(generally designated as wall apertures 312) each having an angled ramp portion 313 and a dwell portion 314, which together form a cam surface 315. Each wall aperture 312 receives a corresponding projection extending radially outward from second collar 370 in order to prevent second collar 370 from exiting second frame portion 310. In the example embodiment illustrated, radial projections extending from second collar 370 include sliding lugs 372 and a second collar arm 374. Second collar arm 374 includes an elongated slot 375 at a free end thereof and is used to connect second drive coupler 350 to the same drive linkage connected to first drive coupler 320 for moving second drive coupler 350 between the extended and retracted positions in response to insertion and removal of toner cartridge 100 from image forming device 22, as discussed in greater detail below. Sliding lugs 372 extend through wall apertures 312*a*, 312*b*, respectively, while second collar arm 374 extends through wall aperture 312*c*. Sliding lugs 372 and second collar arm 374 of second collar 370 are slidable against corresponding angled ramped portions 313 and dwell portions 314 on wall apertures 312 in a similar manner to sliding lugs 342 and first collar arm 344 of first collar 340 discussed above.

Second collar 370 has a rim 371 that limits the axial movement of output plate 360 to help prevent output plate 360 from exiting frame housing 302. Due to the biasing force provided by compression spring 380 on output plate 360, output plate 360 is biased against rim 371 of second collar 370 causing output plate 360 to continuously bias second collar 370 axially outward toward second opening 310*a*, which, in turn, causes sliding lugs 372 and second collar arm 374 to be continuously biased against corresponding cam surfaces 315 formed by angled ramp portions 313 and dwell portions 314. Angled ramped portion 313 and dwell portion 314 of each wall aperture 312 defines a range of axial travel of output plate 360. For example, movement of second collar 370 toward second opening 310*a*, such as the result of the biasing force of compression spring 380, causes sliding lugs 372 and second collar arm 374 of second collar 370 to slide against corresponding angled ramped portions 313 of wall apertures 312 until each of sliding lugs 372 and second collar arm 374 reaches and rests against corresponding dwell portions 314 and drive collar 362 is extended through second opening 310*a* in the extended position (FIGS. 7A and 7B). Conversely, movement of second collar 370 inwardly toward frame plate 98, such as when the biasing force of compression spring 380 is overcome, causes sliding lugs 372 and second collar arm 374 to slide from corresponding dwell portions 314 to corresponding angled ramped portions 313 until drive collar 362 of output plate 360 is positioned within first frame portion 304 in the retracted position (FIGS. 6A and 6B).

Figure 9:
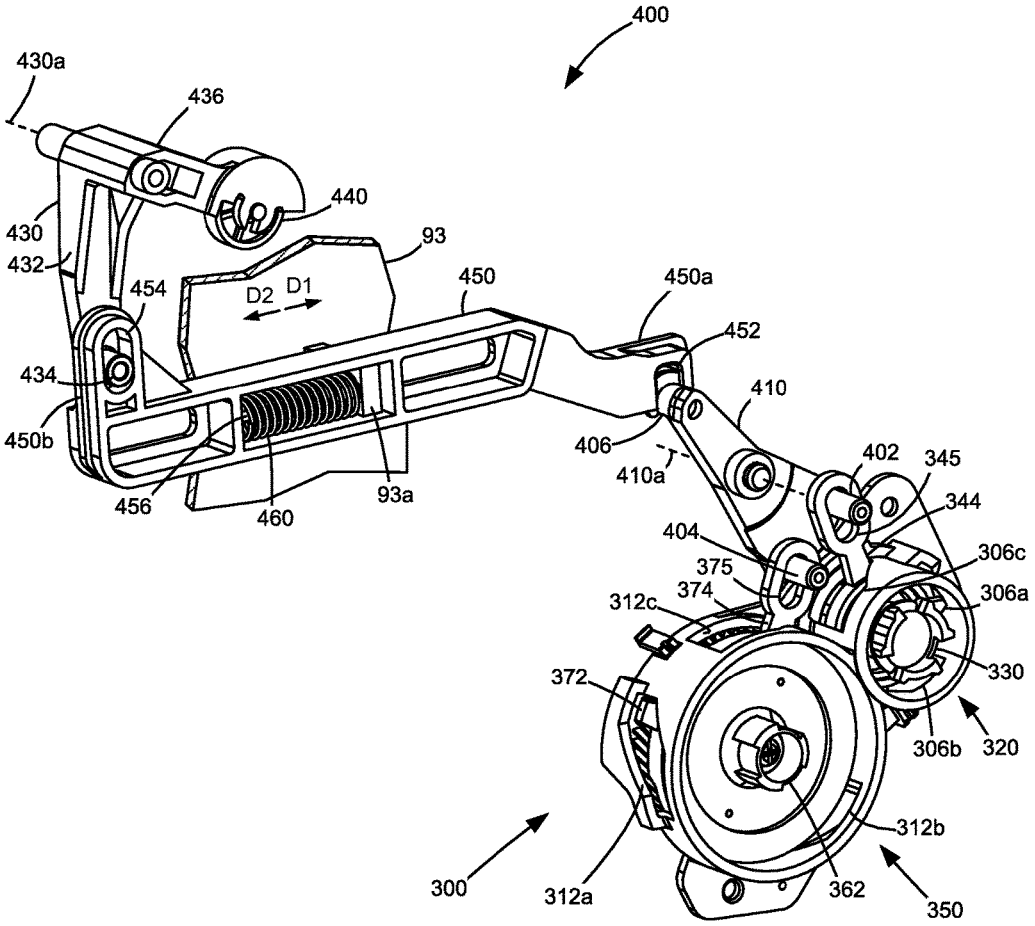
FIG. 9 is a perspective view of a movable drive linkage assembly connected to the drive system according to one example embodiment.

With reference to FIG. 9, image forming device 22 includes a movable drive linkage assembly 400 mounted on side 82 of image forming device 22. Drive linkage assembly 400 is engagable and movable by toner cartridge 100 upon insertion of toner cartridge 100 into image forming device 22. Drive linkage assembly 400 is also operatively connected to first and second drive couplers 320, 350 such that drive linkage assembly 400 moves each of first and second drive couplers 320, 350 from the retracted position to the extended position upon drive linkage assembly 400 receiving an actuation force from the insertion of toner cartridge 100 into image forming device 22. In addition, in the embodiment illustrated, drive linkage assembly 400 also provides a hold-down force on toner cartridge 100 as toner cartridge 100 is seated in its final operating position within image forming device 22, as discussed in greater detail below. Removal of toner cartridge 100 from image forming device 22 disengages toner cartridge 100 from contacting drive linkage assembly 400 thereby removing the actuation force acting on drive linkage assembly 400 and returning each of first and second drive couplers 320, 350 from the extended position to the retracted position. This allows imaging unit 200 to be removed from image forming device 22 without being obstructed by first and second drive couplers 320, 350.

In the example embodiment illustrated, drive linkage assembly 400 includes a first bell crank 410, a second bell crank 430 and a linkage 450 connected between first and second bell cranks 410, 430. Linkage 450 is shown as an elongated member having a first end 450*a* and a second end 450*b* and movable, e.g., translatable, along directions D1, D2. Linkage 450 is operatively connected to drive system 300 to move each of first and second drive couplers 320, 350 from the retracted position to the extended position when linkage 450 moves in a first direction D1 upon insertion of toner cartridge 100 into image forming device 22. In the example embodiment illustrated, linkage 450 is connected at first end 450*a* to first bell crank 410 which is arranged to move first and second drive couplers 320, 350 of drive system 300 between the retracted and extended positions. Linkage 450 is biased by one or more biasing members, such as a biasing spring 460 connected between a spring post 456 on linkage 450 and a spring mount 93*a* provided on a side plate 93 of image forming device 22, toward a second direction D2 opposite first direction D1.

First bell crank 410 is positioned to move each of first and second drive couplers 320, 350 between the retracted position and the extended position. In the embodiment illustrated, first bell crank 410 is pivotable about a first pivot axis 410*a*. First bell crank 410 includes first and second pins 402, 404 that pass through slots 345, 375 of first and second collar arms 344, 374 of first and second drive coupler assemblies 320, 350, respectively. A post 406 provided on the distal end of first bell crank 410 is connected to first end 450*a* of linkage 450 by passing through an open-ended slot 452 formed at first end 450*a* of linkage 450. The biasing force of biasing spring 460 on linkage 450 in direction D2 biases first bell crank 410 counter-clockwise as viewed in FIG. 9 overcoming the bias applied to each of first and second collars 340, 370 of first and second drive couplers 320, 350 by biasing members 336, 380, respectively. As a result, first and second drive couplers 320, 350 are biased toward their respective retracted positions with sliding lugs 342, 372 and first and second collar arms 344, 374 positioned at respective ends 307*a*, 313*a* of angled ramped portions 307, 313 of corresponding wall apertures 306, 312.

Second bell crank 430 is positioned to rotate in response to insertion and removal of toner cartridge 100 and move linkage 450 in directions D1 and D2. In the example embodiment illustrated, second bell crank 430 is pivotable about a pivot axis 430*a*. Second bell crank 430 includes a first arm portion 432 and a second arm portion 436 extending from pivot axis 430*a* and at an angle relative to each other. A post 434 provided on a distal end of first arm portion 432 is connected to linkage 450 by passing through a slot 454 at second end 450*b* of linkage 450. In the example embodiment illustrated, a roller 440 is rotatably mounted at a free end of second arm portion 436 and is positioned to be engagable by engagement member 164 of toner cartridge 100 upon insertion of toner cartridge 100 into image forming device 22. The biasing force of biasing spring 460 on linkage 450 in direction D2 biases second bell crank 430 clockwise as viewed in FIG. 9.

Figure 10A:
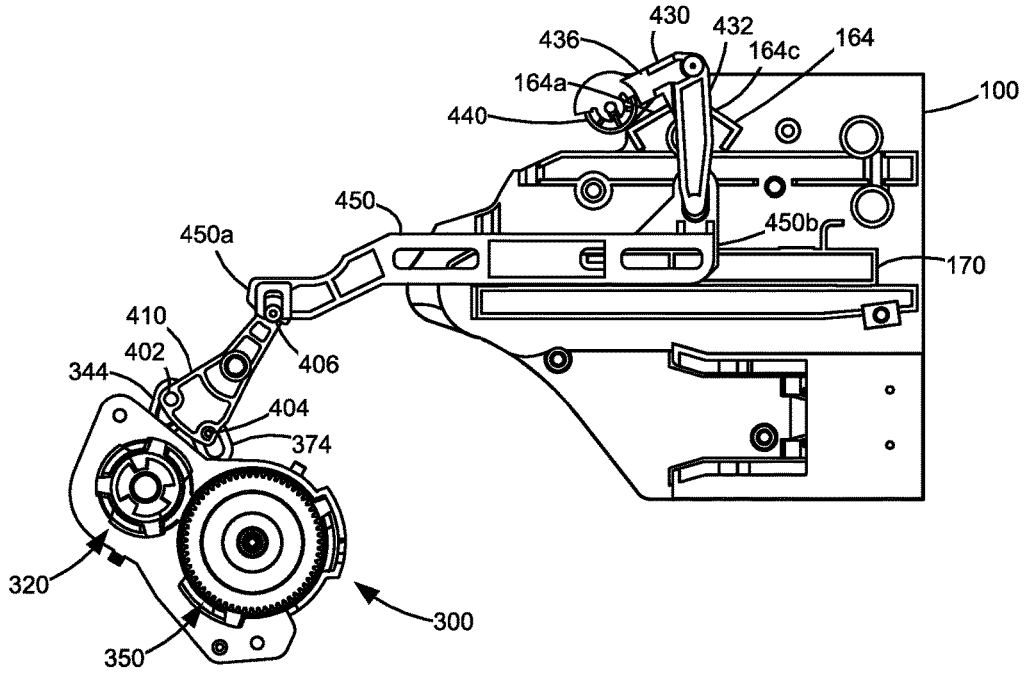
FIGS. 10A-10D are sequential side elevation views of the drive linkage assembly as the toner cartridge is inserted into the image forming device according to one example embodiment.
Figure 10B:
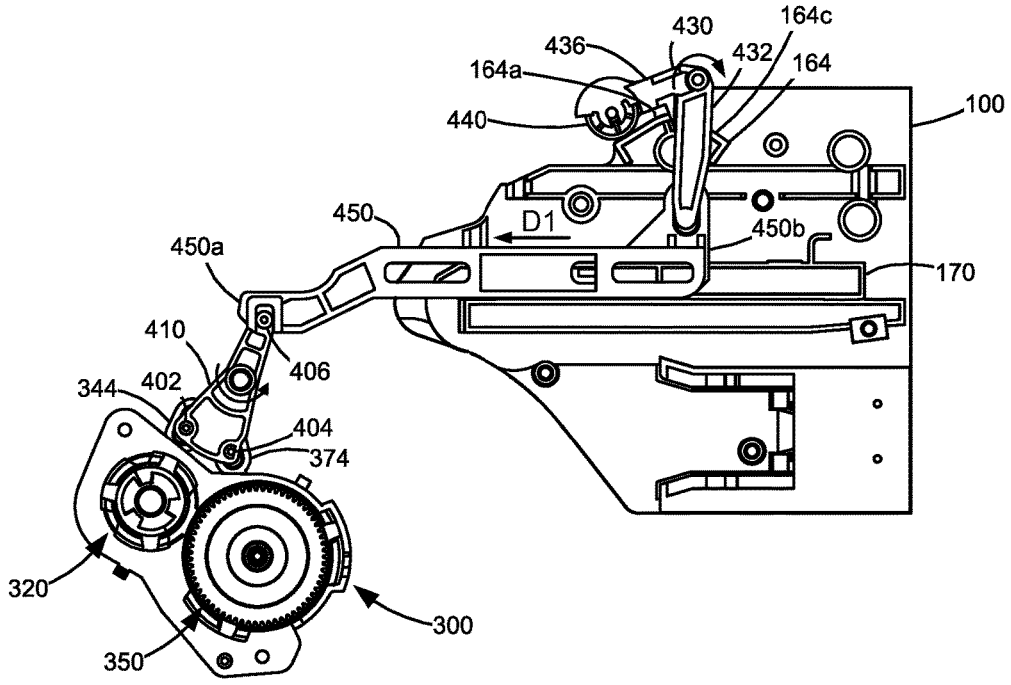

FIGS. 10A-10D are sequential views showing the operation of drive linkage assembly 400 as toner cartridge 100 is inserted into image forming device 22. In the absence of toner cartridge 100, the biasing force of biasing spring 460 in drive linkage assembly 400 overcomes the biasing forces of springs 336, 380 of drive system 300 and holds each of first and second drive couplers 320, 350 in the retracted position (FIGS. 6A and 6B). As toner cartridge 100 is inserted into image forming device 22, alignment guide 170 enters guide slot 92 in image forming device 22. As toner cartridge 100 is inserted further into image forming device 22, roller 440 of second bell crank 430 contacts an angled front surface 164*a* of engagement member 164 as shown in FIG. 10A. As toner cartridge 100 advances further into image forming device 22, engagement member 164 of toner cartridge 100 pushes up on roller 440 allowing roller 440 to move upward on angled front surface 164*a* of engagement member 164 and causes second bell crank 430 to rotate clockwise as viewed in FIG. 10B, overcoming the biasing force of biasing spring 460 and causing linkage 450 to move in direction D1. Movement of linkage 450 in direction D1, in turn, causes first bell crank 410 to rotate counter-clockwise as viewed in FIG. 10B, which causes each of first and second drive couplers 320, 350 to move axially from the retracted position toward the extended position as a result of the axial bias applied by biasing member 336 and compression spring 380.

Figure 10C:
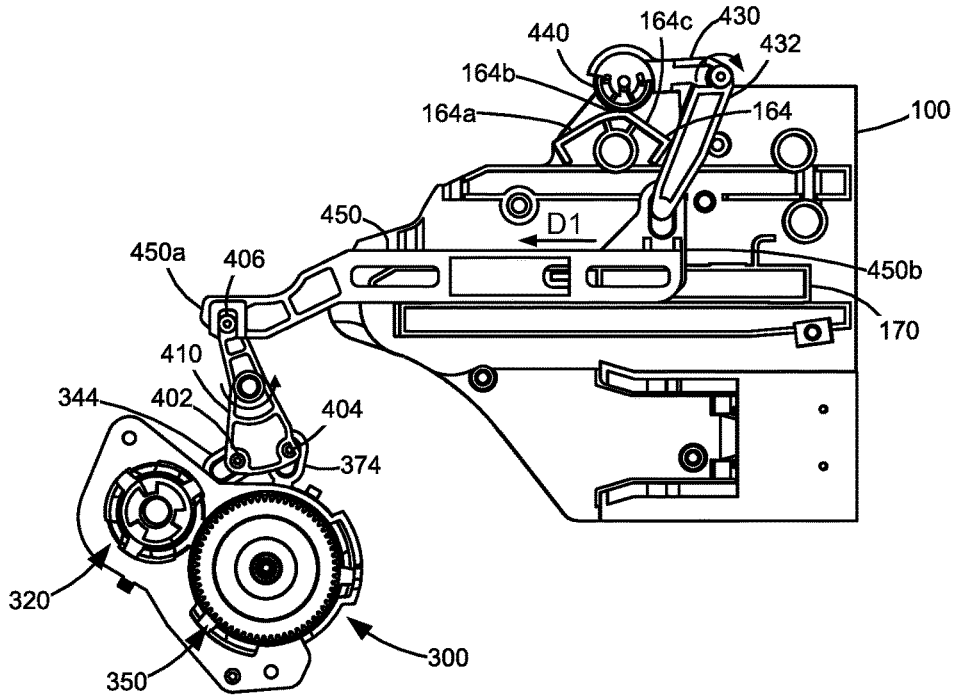
Figure 10D:
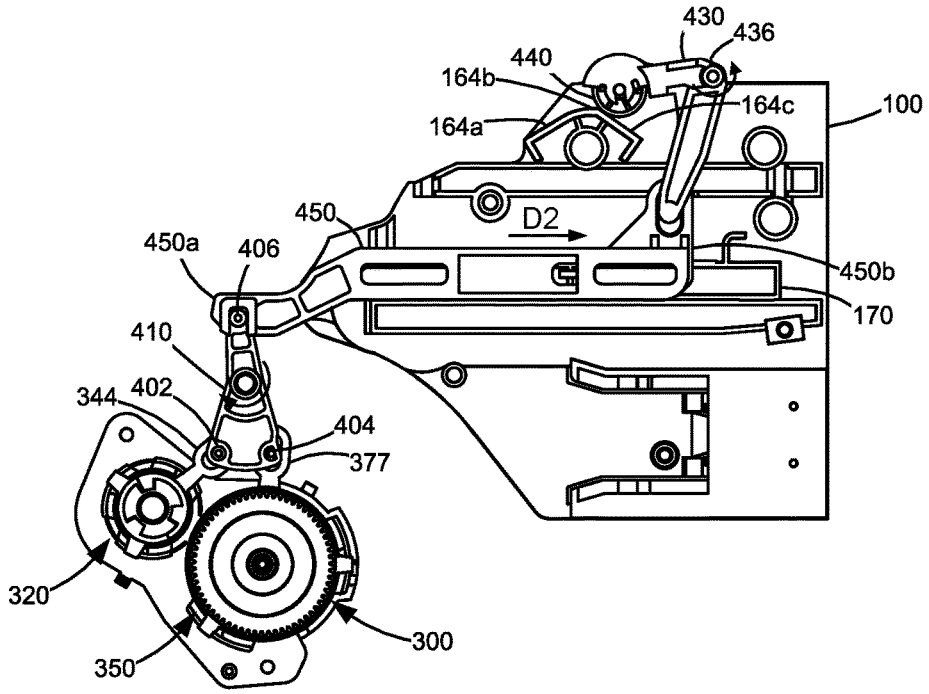

As toner cartridge 100 continues to advance into image forming device 22, roller 440 approaches a peak 164*b* of engagement member 164 and second bell crank 430 rotates further clockwise as viewed in FIG. 10C, with linkage 450 further moving in direction D1 and causing first bell crank 410 to further rotate counter-clockwise as viewed in FIG. 10C, moving each of first and second drive couplers 320, 350 to the extended position (FIGS. 7A and 7B). As toner cartridge 100 advances to its final position within image forming device 22, roller 440 passes over peak 164*b* until roller 440 contacts an angled rear surface 164*c* of engagement member 164. Angled rear surface 164*c* allows for a slight return of drive linkage assembly 400 (i.e., for second bell crank 430 to slightly rotate counter-clockwise, linkage 450 to slightly move back in direction D2 and first bell crank 410 to slightly rotate clockwise as viewed in FIG. 10D as roller 440 moves down angled rear surface 164*c*) to account for system tolerances as toner cartridge 100 comes to a rest and reaches its final position in image forming device 22. The axial positions of first and second drive couplers 320, 350 remain in the extended positions when roller 440 moves along angled rear surface 164*c* of engagement member 164. In particular, sliding lugs 342, 372 and first and second collar arms 344, 374 of first and second drive couplers 320, 350 move along corresponding dwell portions 308, 314 of wall apertures 306, 312 such that first and second drive couplers 320, 350 remain in their extended positions as roller 440 passes over peak 164*b* of engagement member 164 and moves along angled rear surface 164*c* thereof.

Figure 11:
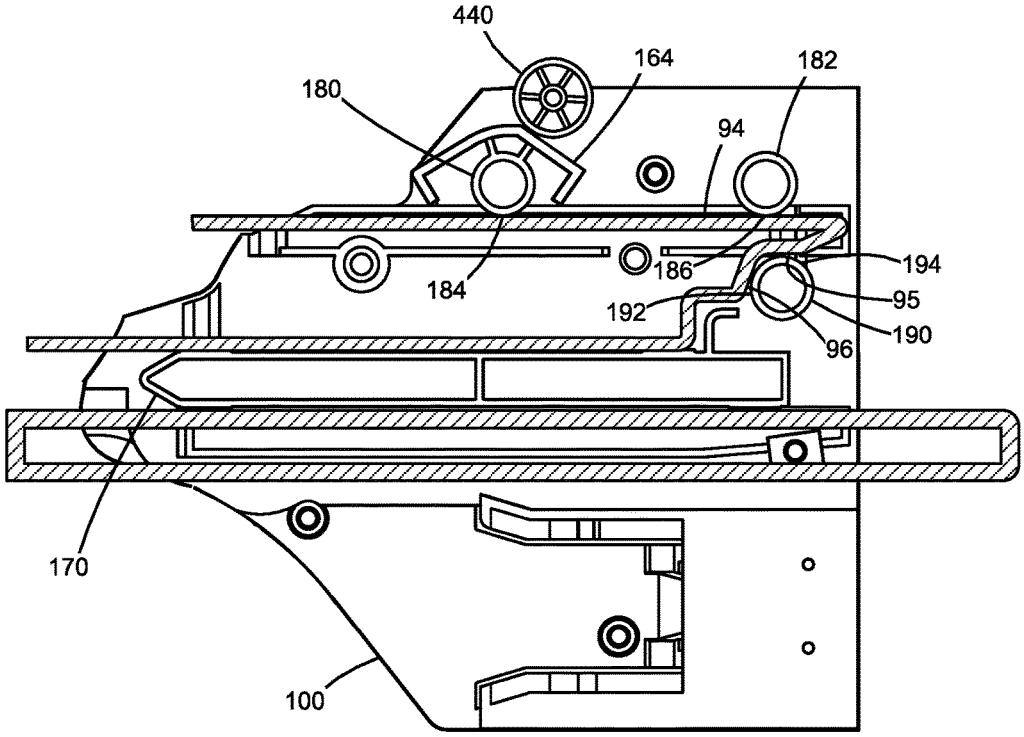
FIG. 11 is a side elevation view of the toner cartridge with the toner cartridge in a final position in the image forming device according to one example embodiment.

Due to the biasing force of biasing spring 460 on second bell crank 430, roller 440 applies a hold-down force to angled rear surface 164*c* of engagement member 164, which urges toner cartridge 100 toward its final position in image forming device 22 and helps retain toner cartridge 100 in its final position in image forming device 22. Accordingly, in the example embodiment illustrated, drive linkage assembly 400 not only provides actuation for drive system 300 in response to the insertion of toner cartridge 100 but also acts as a biasing member, via second bell crank 430 and roller 440, to provide a hold-down force on toner cartridge 100 as toner cartridge 100 is fully seated in its final operating position within image forming device 22. In the example embodiment illustrated in FIG. 11, the force applied by roller 440 to engagement member 164 helps maintain contact between bottom surfaces 184, 186 of alignment guides 180, 182 and guide surface 94 on side 108 of housing 102 in order to maintain the vertical position of toner cartridge 100 as well as contact between front surface 192 of alignment guide 190 and guide surface 96 in order to maintain the horizontal position of toner cartridge 100 along the front-to-rear dimension of housing 102.

When toner cartridge 100 is removed from image forming device 22, the operation of drive linkage assembly 400 discussed above is reversed. Initially, roller 440 rides up angled rear surface 164*c* of engagement member 164 and reaches peak 164*b* as shown in FIG. 10C. As toner cartridge 100 is further removed from image forming device 22, roller 440 moves down angled front surface 164*a* of engagement member 164 as a result of the biasing force applied by biasing spring 460 causing second bell crank 430 to rotate counter-clockwise, linkage 450 to move in direction D2 and first bell crank 410 to rotate clockwise, all as viewed in FIG. 10B, until engagement member 164 of toner cartridge 100 disengages from contacting roller 440 and each of first and second drive couplers 320, 350 return to the retracted position (FIGS. 6A and 6B). As discussed above, in the absence of toner cartridge 100, the biasing force of biasing spring 460 overcomes the biasing forces of springs 336, 380 of drive system 300 and holds each of first and second drive couplers 320, 350 in the retracted position (FIGS. 6A and 6B).

While the example embodiment illustrated includes a drive linkage assembly 400 that engages and disengages drive couplers 320, 350 that provide rotational motion to components of an imaging unit 200 in response to the installation and removal of a toner cartridge 100, it will be appreciated that such an assembly may be configured to engage and disengage drive coupler(s) of any rotatable component within image forming device 22, such as, for example, one or more media feed rolls, one or more toner agitators, fuser 37, etc., in response to the installation and removal of any replaceable unit of image forming device 22 as desired.

Further, while the example embodiment illustrated includes a drive linkage assembly having a pair of bell cranks and a translatable linkage connected between them, it will be appreciated that a variety of mechanisms may be used to actuate drive couplers 320, 350 in response to the insertion and removal of toner cartridge 100 into and out of image forming device 22, including, for example, any suitable combination of rotating, translating or other mechanisms.

Although the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202 and cleaner unit 204 are housed in one replaceable unit. In another embodiment, the main toner supply for image forming device 22 and developer unit 202 are provided in a first replaceable unit and cleaner unit 204 is provided in a second replaceable unit. Further, although the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A system for an electrophotographic image forming device, comprising:

a first replaceable unit insertable into the image forming device, the first replaceable unit having a drive interface exposed on an exterior of the first replaceable unit;

a drive coupler mounted in the image forming device, the drive coupler is movable between a disengaged position and an engaged position, in the disengaged position the drive coupler is disengaged from the drive interface of the first replaceable unit when the first replaceable unit is installed in the image forming device, in the engaged position the drive coupler is engaged with the drive interface of the first replaceable unit when the first replaceable unit is installed in the image forming device for transferring rotational force from the drive coupler to the drive interface of the first replaceable unit;

a second replaceable unit insertable into the image forming device; and a movable drive linkage mounted in the image forming device and operatively connected to the drive coupler such that the movable drive linkage moves the drive coupler from the disengaged position to the engaged position upon the movable drive linkage receiving an actuation force from the insertion of the second replaceable unit into the image forming device.

2. The system of claim 1, further comprising a first pivotable bell crank operatively connected to the movable drive linkage such that rotation of the first pivotable bell crank upon the first pivotable bell crank contacting the second replaceable unit and receiving an actuation force from the insertion of the second replaceable unit into the image forming device moves the movable drive linkage causing the movable drive linkage move the drive coupler from the disengaged position to the engaged position.

3. The system of claim 2, further comprising a second pivotable bell crank operatively connected to the drive coupler such that movement of the movable drive linkage rotates the second pivotable bell crank causing the second pivotable bell crank to move the drive coupler between the disengaged position and the engaged position.

4. The system of claim 2, wherein when the second replaceable unit is fully installed in the image forming device the first pivotable bell crank provides a hold-down force on the second replaceable unit that holds the second replaceable unit in place in the image forming device.

5. The system of claim 1, wherein the drive coupler is biased toward the disengaged position.

6. The system of claim 5, wherein a biasing member in contact with the movable drive linkage biases the drive coupler toward the disengaged position.

7. The system of claim 1, wherein the second replaceable unit includes a toner reservoir and an outlet in fluid communication with the toner reservoir for exiting toner from the second replaceable unit and the first replaceable unit includes an inlet for receiving toner from the outlet of the second replaceable unit.

8. A system for an electrophotographic image forming device, comprising:

a toner cartridge removable from the image forming device, the toner cartridge having a toner reservoir and an outlet in fluid communication with the toner reservoir for exiting toner from the toner cartridge;

an imaging unit removable from the image forming device separately from the toner cartridge, the imaging unit having a toner reservoir and an inlet for receiving toner from the outlet of the toner cartridge, the imaging unit having a drive interface for receiving a rotational force;

a drive coupler mounted in the image forming device and movable between a retracted position and an operative position, in the retracted position the drive coupler is disengaged from the drive interface of the imaging unit when the imaging unit is installed in the image forming device, in the operative position the drive coupler is engaged with the drive interface of the imaging unit when the imaging unit is installed in the image forming device for providing the rotational force from the drive coupler to the drive interface of the imaging unit; and a movable drive linkage mounted in the image forming device and operatively connected to the drive coupler such that the movable drive linkage moves the drive coupler from the retracted position to the operative position upon the movable drive linkage receiving an actuation force from the insertion of the toner cartridge into the image forming device.

9. The system of claim 8, further comprising a first pivotable bell crank operatively connected to the movable drive linkage such that rotation of the first pivotable bell crank upon the first pivotable bell crank contacting the toner cartridge and receiving an actuation force from the insertion of the toner cartridge into the image forming device moves the movable drive linkage causing the movable drive linkage move the drive coupler from the retracted position to the operative position.

10. The system of claim 9, further comprising a second pivotable bell crank operatively connected to the drive coupler such that movement of the movable drive linkage rotates the second pivotable bell crank causing the second pivotable bell crank to move the drive coupler between the retracted position and the operative position.

11. The system of claim 9, wherein when the toner cartridge is fully installed in the image forming device the first pivotable bell crank provides a hold-down force on the toner cartridge that holds the toner cartridge in place in the image forming device.

12. The system of claim 8, wherein the drive coupler is biased toward the retracted position.

13. The system of claim 12, wherein a biasing member in contact with the movable drive linkage biases the drive coupler toward the retracted position.

14. An assembly for an electrophotographic image forming device, comprising:

a drive coupler movable between a retracted position and an extended position, in the retracted position the drive coupler is disengaged from a corresponding drive interface of a first replaceable unit when the first replaceable unit is installed in the image forming device, in the extended position the drive coupler is engaged with the corresponding drive interface of the first replaceable unit when the first replaceable unit is installed in the image forming device;

a movable linkage having a first end and a second end;

a first pivotable bell crank operatively connected to the first end of the movable linkage and to the drive coupler such that movement of the movable linkage in a first direction and a second direction, respectively, moves the drive coupler toward the retracted position and the extended position, respectively; and a second pivotable bell crank operatively connected to the second end of the movable linkage such that the movable linkage moves in the second direction upon the second bell crank receiving an actuation force from the insertion of a second replaceable unit into the image forming device moving the drive coupler from the retracted position to the extended position.

15. The assembly of claim 14, wherein when the second replaceable unit is fully installed in the image forming device the second pivotable bell crank provides a hold-down force on the second replaceable unit that holds the second replaceable unit in place in the image forming device.

16. The assembly of claim 14, wherein the drive coupler is biased toward the retracted position.

17. The assembly of claim 16, wherein a biasing member in contact with the movable linkage biases the movable linkage in the first direction thereby biasing the drive coupler toward the retracted position.

18. The assembly of claim 14, wherein the second pivotable bell crank includes a first arm and a second arm, the first arm is operatively connected to the movable linkage and the second arm has a free end that is positioned to contact the second replaceable unit and receive the actuation force from the insertion of the second replaceable unit into the image forming device.

* * * * *